US010640275B2

(12) United States Patent
McGrath et al.

(10) Patent No.: US 10,640,275 B2
(45) Date of Patent: May 5, 2020

(54) DUAL CHAMBER STORAGE DEVICE

(71) Applicant: Bio-Techne Corporation, Minneapolis, MN (US)

(72) Inventors: Paul V. McGrath, Bedford, MA (US); Thomas M. Pizza, Dracut, MA (US); Jerry W. Westwood, Gardner, MA (US); Steven L. Hjelm, Leominster, MA (US); Keith M. Simeone, Lunenburg, MA (US)

(73) Assignee: BIO-TECHNE CORPORTION, Minneapolis, MN (US)

( * ) Notice: Subject to any disclaimer, the term of this patent is extended or adjusted under 35 U.S.C. 154(b) by 0 days.

(21) Appl. No.: 16/006,283

(22) Filed: Jun. 12, 2018

(65) Prior Publication Data

US 2018/0354703 A1 Dec. 13, 2018

Related U.S. Application Data

(60) Provisional application No. 62/518,279, filed on Jun. 12, 2017, provisional application No. 62/658,921, filed on Apr. 17, 2018.

(51) Int. Cl.
*B65D 81/32* (2006.01)

(52) U.S. Cl.
CPC ..... *B65D 81/3211* (2013.01)

(58) Field of Classification Search
CPC ..... B65D 81/3211; B65D 81/3205; B60B 1/3205

(Continued)

(56) References Cited

U.S. PATENT DOCUMENTS 3,200,995 A * 8/1965 Gangwisch ..... B65D 47/242 222/94
3,220,588 A * 11/1965 Lipari ..... B65D 25/08 206/222

(Continued)

FOREIGN PATENT DOCUMENTS

AU 6335096 A 4/1997
EP 561322 B1 10/1996

(Continued)

OTHER PUBLICATIONS

ACU-Cap, Eurotrol, Retrieved online from <https://www.eurotrol.com/products/packaging-concepts/p/acu-cap> on Jan. 3, 2019, 1 page.

(Continued)

*Primary Examiner* — Benjamin R Shaw
(74) *Attorney, Agent, or Firm* — Fredrikson & Byron, P.A.

(57) ABSTRACT

A dual chamber storage device includes a first chamber having a base and a hollow body for storing a first material. A second chamber within the hollow body of the first chamber has a base, a hollow body for storing a second material, and a neck portion. A dispenser housed within the second chamber has a hollow body, a dispensing tip, and a cutting edge. A cap surrounds the end of the dispenser with the cutting edge, is rotatingly connectable with the second chamber neck portion, and is non-rotatingly connectable with the first end of the dispenser. When the cap is rotated relative to the second chamber neck portion, the second end of the dispenser moves toward the base of the second chamber and the cutting edge pierces the base of the second chamber thereby allowing the second material to enter the hollow body of the first chamber.

18 Claims, 9 Drawing Sheets

(58) Field of Classification Search
USPC ..... 222/145.5
See application file for complete search history.

(56) References Cited

U.S. PATENT DOCUMENTS

| | | | | | |
|---|---|---|---|---|---|
| 3,768,697 | A * | 10/1973 | Lerner | B65D 81/3211 | 222/80 |
| 3,968,872 | A * | 7/1976 | Cavazza | B65D 47/18 | 206/222 |
| 5,158,546 | A | 10/1992 | Haber et al. | | |
| 5,186,323 | A | 2/1993 | Pfleger | | |
| 5,387,034 | A * | 2/1995 | Bauer | B05B 11/3084 | 222/145.5 |
| 5,613,623 | A * | 3/1997 | Hildebrandt | B65D 81/3211 | 206/221 |
| 5,782,345 | A * | 7/1998 | Guasch | B65D 41/3409 | 206/219 |
| 5,875,889 | A * | 3/1999 | Albisetti | B65D 1/06 | 206/221 |
| 5,927,549 | A * | 7/1999 | Wood | B65D 51/285 | 206/222 |
| 6,073,803 | A * | 6/2000 | Sturm | B65D 51/2871 | 206/222 |
| 6,098,795 | A * | 8/2000 | Mollstam | A23C 9/1234 | 206/222 |
| 7,614,496 | B2 | 11/2009 | Dvorak et al. | | |
| 7,748,550 | B2 * | 7/2010 | Cho | B65D 51/285 | 206/222 |
| 8,376,988 | B2 * | 2/2013 | Perovitch | A61J 1/067 | 206/222 |
| D697,225 | S | 1/2014 | Maas | | |
| 8,973,749 | B2 * | 3/2015 | Pearcy | B01F 13/0023 | 206/222 |
| 9,085,397 | B2 | 7/2015 | Maas | | |
| D767,159 | S | 9/2016 | Maas | | |
| 2002/0020636 | A1 * | 2/2002 | Bergamini | A61J 1/2093 | 206/219 |
| 2002/0040856 | A1 * | 4/2002 | Mollstam | A61J 9/00 | 206/222 |
| 2002/0179461 | A1 * | 12/2002 | Mollstam | B65D 47/2031 | 206/222 |
| 2005/0274744 | A1 * | 12/2005 | Spada | A61F 9/0026 | 222/240 |
| 2008/0314775 | A1 * | 12/2008 | Owoc | B65D 25/08 | 206/222 |
| 2010/0016826 | A1 | 1/2010 | Billiet-Prades et al. | | |
| 2010/0163442 | A1 * | 7/2010 | Lee | B65D 47/243 | 206/222 |
| 2012/0199503 | A1 * | 8/2012 | Dyrbye | B65D 47/243 | 206/222 |
| 2013/0175188 | A1 * | 7/2013 | Scarpa | B65D 51/2821 | 206/222 |
| 2013/0313138 | A1 * | 11/2013 | Thoman | B65D 51/285 | 206/222 |
| 2014/0209490 | A1 * | 7/2014 | McKeown | B65D 51/2821 | 206/222 |
| 2014/0334252 | A1 * | 11/2014 | Harand | A61M 5/2425 | 366/348 |
| 2015/0175337 | A1 * | 6/2015 | Lee | B65D 51/2835 | 206/219 |
| 2016/0023825 | A1 * | 1/2016 | Van Den Broek | B65D 81/3211 | 215/227 |
| 2016/0083156 | A1 * | 3/2016 | Dyrbye | B65D 51/2828 | 206/222 |

FOREIGN PATENT DOCUMENTS

| | | | |
|---|---|---|---|
| EP | 1002737 | A1 | 5/2000 |
| EP | 1068850 | A2 | 1/2001 |
| EP | 1121922 | A2 | 8/2001 |
| EP | 1518574 | B1 | 8/2009 |
| GB | 2271557 | B | 2/1996 |
| WO | 9622919 | A1 | 8/1996 |
| WO | 9730898 | A1 | 8/1997 |
| WO | 9749611 | A1 | 12/1997 |
| WO | 0196186 | A1 | 12/2001 |
| WO | 0236065 | A1 | 5/2002 |
| WO | 2004014476 | A1 | 2/2004 |
| WO | 2005040000 | A1 | 5/2005 |
| WO | 2005097251 | A1 | 10/2005 |
| WO | 2006008255 | A1 | 1/2006 |
| WO | 2006066981 | A1 | 6/2006 |
| WO | 2006070003 | A1 | 7/2006 |
| WO | 2006097823 | A2 | 9/2006 |
| WO | 2006111803 | A2 | 10/2006 |
| WO | 2007144742 | A2 | 12/2007 |
| WO | 2008117149 | A1 | 10/2008 |
| WO | 2009019527 | A1 | 2/2009 |
| WO | 2010013106 | A1 | 2/2010 |
| WO | 2010035086 | A1 | 4/2010 |
| WO | 2010089651 | A2 | 8/2010 |
| WO | 2010089653 | A1 | 8/2010 |
| WO | 2010148321 | A1 | 12/2010 |
| WO | 2012014028 | A1 | 2/2012 |
| WO | 2014142655 | A1 | 9/2014 |

OTHER PUBLICATIONS

Dual Chamber Bottles, LF of America, Retrieved online from <https://www.lfofamerica.com/product/dual-chamber-bottles/> on Jan. 3, 2019, 4 pages.

Lyophilized Quality Controls, Labcompare, Retrieved online from <https://www.labcompare.com/Clinical-Diagnostics-Equipment/25030-Lyophilized-Quality-Control-Reagents/> on Jan. 3, 2019, 7 pages.

Serum Chemistry Quality Controls, Bio-Rad, Retrieved online from <http://www.bio-rad.com/en-us/category/serum-chemistry-quality-controls?ID=27a9838d-dd25-4efa-b40e-a19422645ca6&pcp_loc=catprod> on Jan. 3, 2019, 2 pages.

Linearity FD General Chemistry, Audit MicroControls, INS038 Rev: 007, Retrieved online from <www.auditmicro.com/downloads/dl/file/id/459/general_chemistry_linearity_set_lot_06478.pdf., Aug. 22, 2014, 4 pages.

* cited by examiner

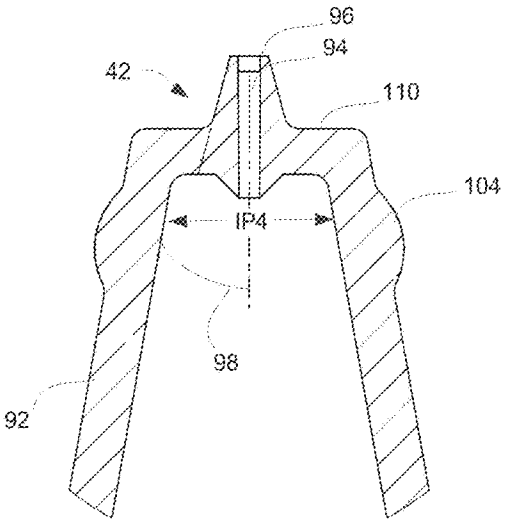
FIG. 7C
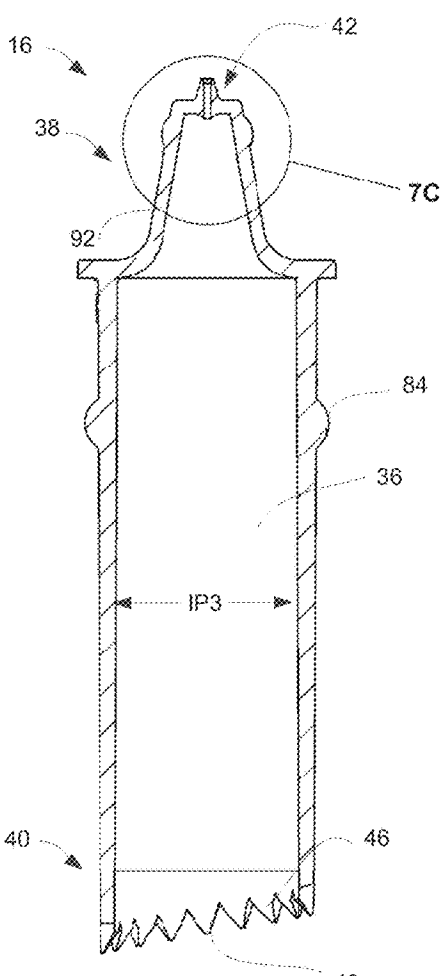
FIG. 8
FIG. 7B
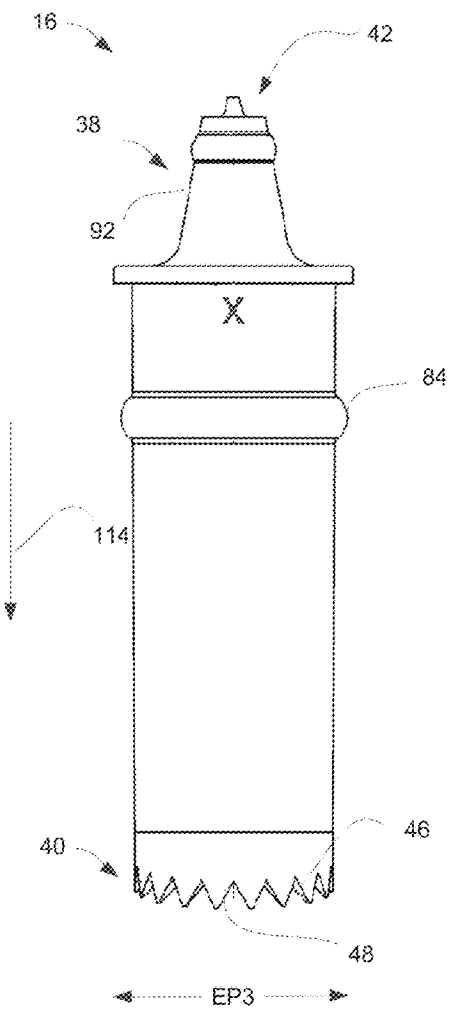
FIG. 7A

DUAL CHAMBER STORAGE DEVICE

RELATED APPLICATIONS

This application claims the benefit of U.S. Provisional Patent Application No. 62/658,921, filed Apr. 17, 2018, and U.S. Provisional Patent Application No. 62/518,279, filed Jun. 12, 2017, the entire contents of both applications are incorporated herein by reference.

BACKGROUND

One or more materials typically have to be mixed prior to use. Materials are often stored separately and then manually mixed prior to use. The process of accurately measuring, combining, and dispensing media can be susceptible to error. Therefore, it would be desirable to provide a device that holds materials separate and stable until time of use, while simultaneously providing a mechanism for combining the materials prior to dispensing the mixture or sampling the mixture by a machine or device.

BRIEF DESCRIPTION OF DRAWINGS

FIG. 7A is a front view of a dispenser of the dual chamber storage according to an exemplary embodiment; and FIG. 7B is a sectional view of the dispenser shown in FIG. 7A; and FIG. 7C is an enlarged sectional view of the dispenser shown in FIG. 7B;

FIG. 8 is an enlarged sectional view of the cap shown in FIG. 4B;

SUMMARY

Figure 2:
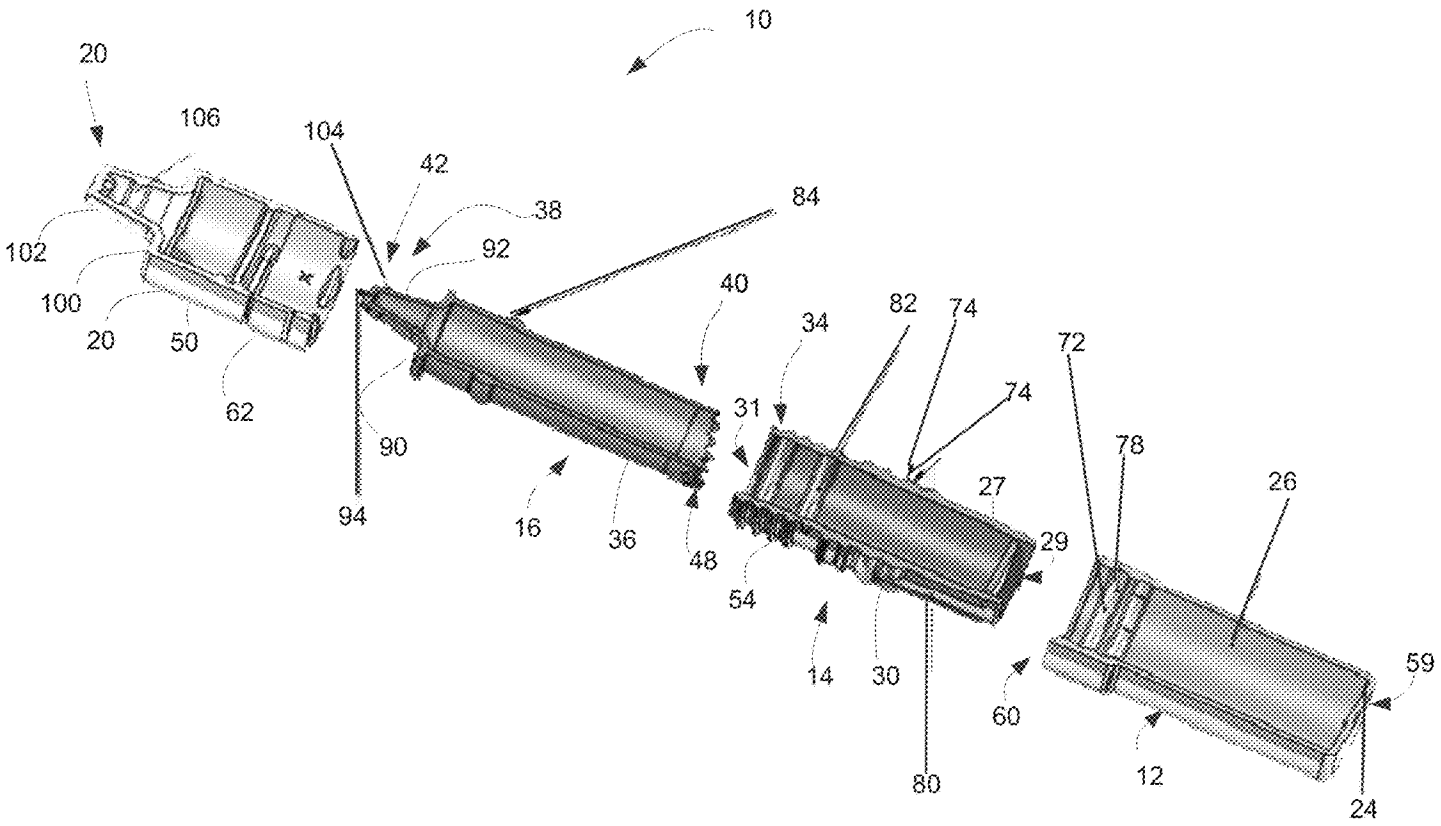
FIG. 2 is an exploded perspective view of the dual chamber storage device shown in FIG. 1.

The present disclosure provides a dual chamber storage device 10 that stores a first material 28 and a second material 32 desired to be mixed together into a mixture prior to use. During storage, the first material 28 and the second material 32 remain separated. The dual chamber storage device 10 includes a first chamber 12, a second chamber 14, a dispenser 16 and a cap 20. The first chamber 12 stores the first material 28 and the second chamber 14 stores the second material 32.

In certain examples, first material 28 is in one state whereas the second material 32 is in another state. For example, the first material 28 can be a solid whereas the second material 32 can be a liquid or a semi-solid. In other examples, the first material 28 can be a liquid whereas the second material 32 can be a solid or semi-solid. In other examples, the first material 28 can be a semi-solid whereas the second material 32 can be a solid or a liquid. In yet other examples, first material 28 and the second material 32 are in the same state. For example, both materials can be a liquid. Also, both materials can be a semi-solid. Solid materials include but are not limited to powders, pellets, lyophilized materials. Liquid materials include but are not limited to water, alcohol, solvents. Further, the first material 28 is present in a predetermined amount and the second material 32 is present in a predetermined amount.

The first chamber 12 includes a hollow body 26 that stores the first material 28. The first chamber 12 is also generally non-deformable, such that the size and shape of the first chamber 12 remains substantially fixed during use of the device 10. In some cases, the first chamber 12 can be made of a material to have a sufficient thickness and rigidity so as to be generally non-deformable but capable of being squeezed.

The second chamber 14 also includes a hollow body 30 that stores second material 32. The second chamber 14 can transform between a deformed state and a non-deformed state. In the non-deformed state, the second chamber 14 is not deformed and the first material 28 in the first chamber 12 is separated from the second material 32 in the second chamber 14. The first material 28 and the second material 32 even remain separated when the device 10 is inverted or shaken.

In the deformed state, the second chamber 14 includes a portion that is deformed such that the second material 32 enters into the first chamber 12 and mixes with the first material 28 to form a mixture. The mixture can then pass back and forth through the first chamber 12 and the second chamber 14 and out of the device through the dispenser 16.

The deformable portion can be any component of the second chamber 14 that can be deformed to allow the second material 32 to enter into the first chamber 12. In some cases, the deformable portion is a deformable base 27. In certain examples, the deformable base 27 comprises a material that can be deformed by cutting or piercing. In some cases, the base 27 comprises a deformable material whereas the remaining components of the second chamber 14 comprises a non-deformable material.

The dispenser 16 includes a deforming structure that is capable of deforming the deformable portion of the second chamber 14. In some cases, the deforming structure cuts or pierces or otherwise deforms the deformable portion. In some cases, the deforming structure is a deforming edge 48.

The dispenser 16 also includes a dispensing tip 42 for controlling delivery of a mixture of the first material 28 and the second material 32.

The device 10 also includes a cap 20 configured substantially surround an upper portion of the device 10 so as to isolate the device 10 from moisture, dust and other extraneous particles, thereby ensuring product stability. The device 10 can also have one or more fluid-tight seals to reduce or substantially prevent moisture or particle intrusion into the device prior to use. Such fluid-tight seals can also help reduce leakage of materials from the device 10.

When it is desired to mix the first material 28 with the second material 32, a user exerts force on the dispenser 16 to cause the deforming structure to deform the deformable portion of the second chamber 14. Once the second chamber 14 is deformed, the second material 32 in the second chamber 14 moves through the deformed portion to mix with the first material 28 in the first chamber 12. The mixture can also freely travel through the first chamber 12, the second chamber 14 and the dispenser 16, ultimately leaving the device 10 via the dispensing tip 42 of the dispenser 16.

DETAILED DESCRIPTION

Figure 1:
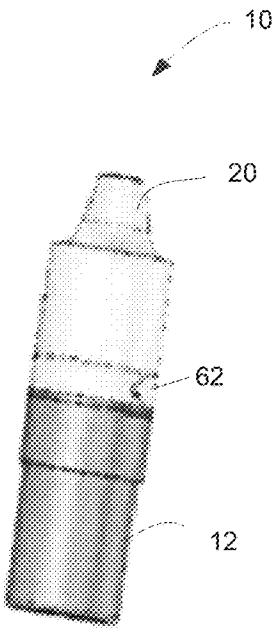
FIG. 1 is a perspective view of a dual chamber storage device according to an exemplary embodiment.
Figure 3:
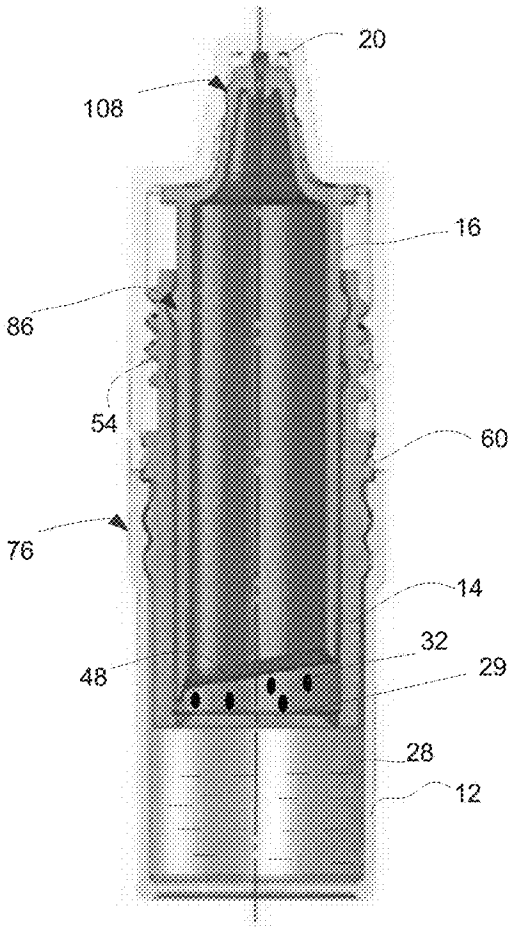
FIG. 3 is a sectional perspective view of the dual chamber storage device shown in FIG. 1.

Certain exemplary embodiments will now be described. FIGS. 1-3 illustrate components of the device 10. The components can be connected together to protect the first material 26 and the second material 32 during non-use. For example, the first chamber 12 and the cap 20 are connected together so as to substantially surround and isolate the second chamber 14 and the dispenser 16 from an outside environment. Also, the second chamber 14 can be nested coaxially within the first chamber 12, while the dispenser 16 can be nested coaxially within the second chamber 14.

As seen from FIGS. 4A-7B, the first chamber 12 has an internal perimeter IP1 and an external perimeter EP1, the second chamber 14 has an internal perimeter IP2 and an external perimeter EP2, the dispenser 16 has an internal perimeter IP3 and an external perimeter EP3 and the cap 20 has an internal perimeter IP5 and an external perimeter EP5. In some cases, the IP1 is larger than the EP2 and IP2 is larger than EP3. In certain cases, the IP1 substantially surrounds the EP2 and the IP2 substantially surrounds the EP3. Such perimeter relationships allow the second chamber 14 to be nested coaxially within the first chamber 12 and the dispenser 16 to be nested coaxially within the second chamber 14.

Further, the cap 20 can substantially surround both the dispenser 16 and the second chamber 14. In some cases, the IP4 is larger than the EP3 and the EP2. This perimeter relationship allows the cap to substantially surround both the dispenser 16 and the second chamber 14. Also, the cap 20 can have an exterior perimeter EP5 that substantially matches or matches the exterior perimeter EP1 first chamber 12. In such cases, the EP5 is substantially close to or substantially the same as the EP1. This allows for the cap 20 and first chamber 12 to connect together and substantially surround and isolate the second chamber 14 and the dispenser 16 from an outside environment.

Figure 6B:
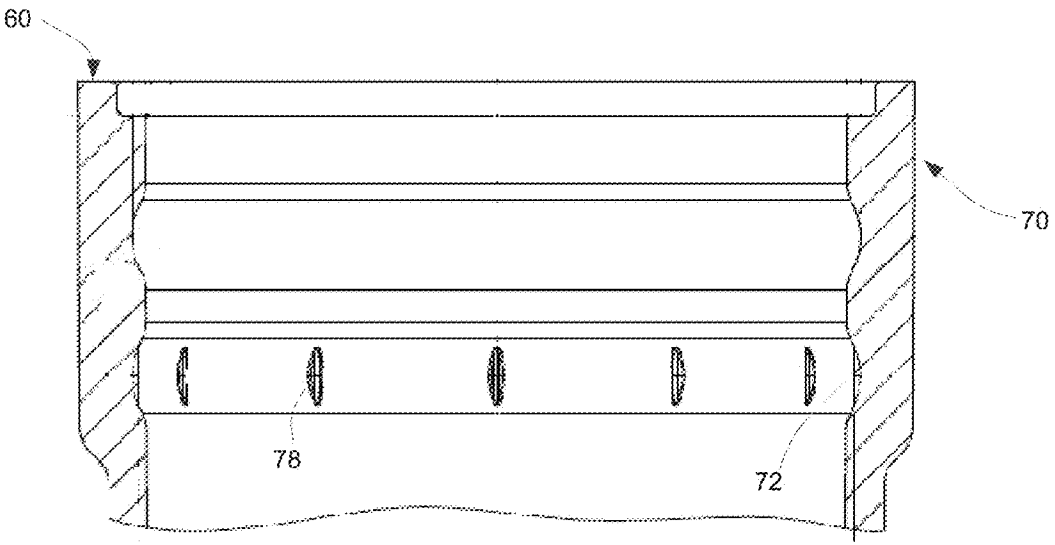
FIG. 6B is an enlarged sectional view of the first chamber shown in FIG. 6A.
Figure 6A:
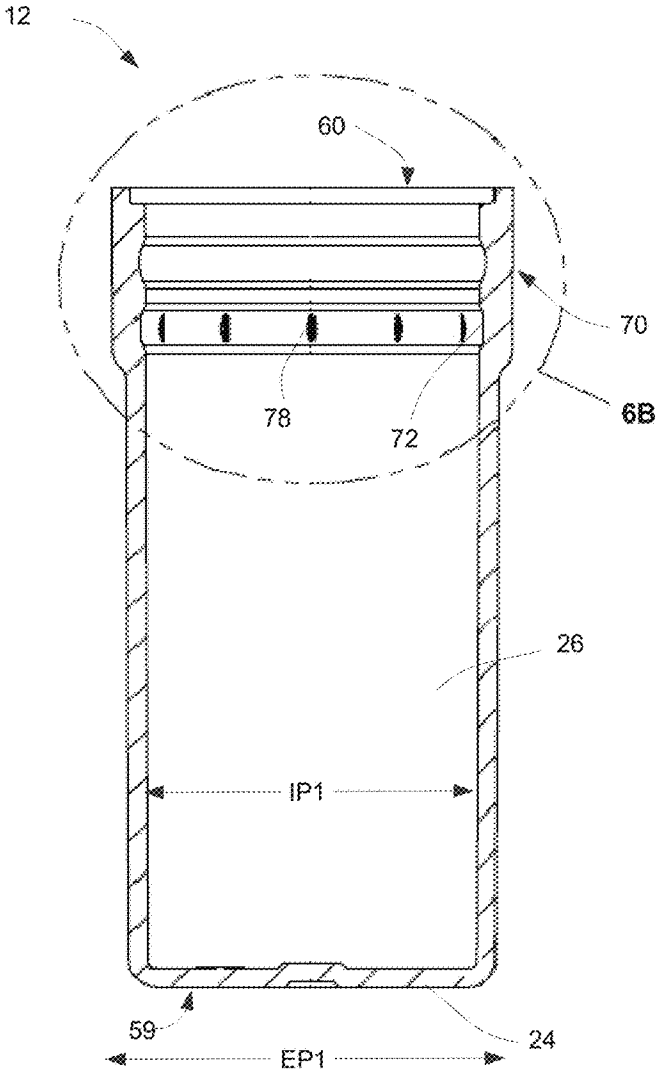
FIG. 6A is a sectional view of a first chamber of the dual chamber storage device according to an exemplary embodiment.
Figure 10:
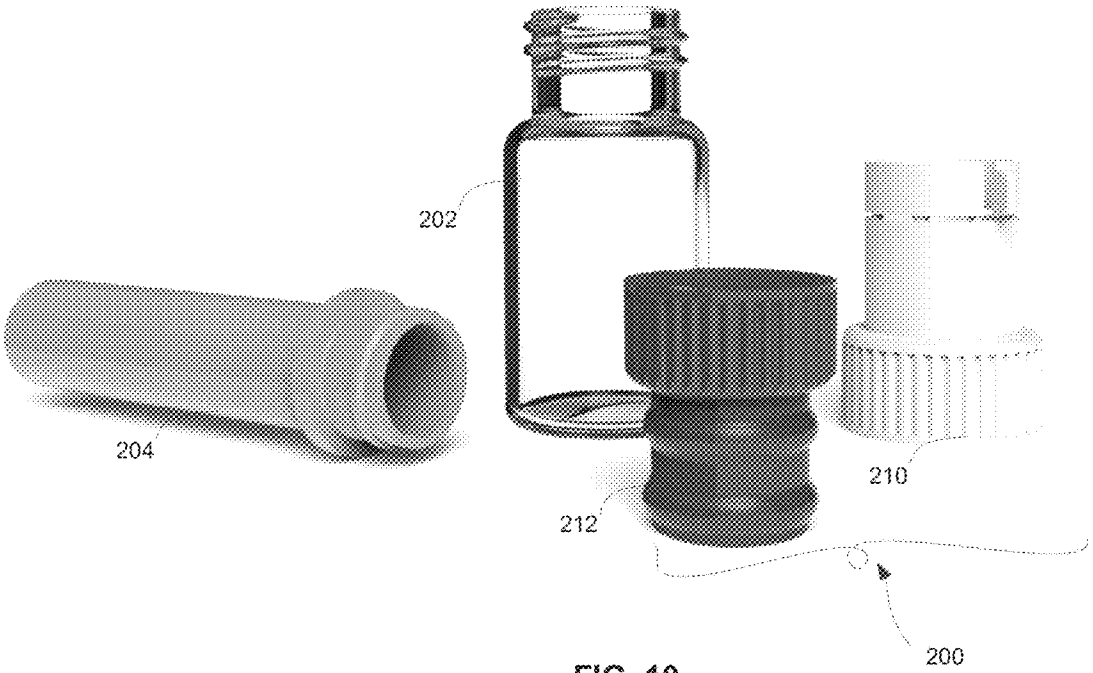
FIG. 10 is a front view of the storage device of FIG. 9 illustrated in a disassembled configuration.

The dual chamber storage device 10 has a first chamber 12 as shown in FIGS. 6A and 6B. The first chamber 12 includes a hollow body 26 that stores a first material 28. In some cases, the entire first chamber 12 is configured to be a hollow body 26. The first chamber 12 has a first end 59 and a second end 60. The first end 59 is opposite the second end 60. The first end 59 includes a base 24 that engages with a support surface. In the illustrated embodiment, a bottom edge of the first end 59 is configured as a base 24. In some cases, the 24 base can be generally planar so as to rest on a generally planar support surface such as a table or shelf.

The first chamber 12 also includes a first chamber neck portion 70 proximal to the second end 60. FIG. 6B perhaps best illustrates the first chamber neck portion 70. The first chamber 12 also includes a sealing portion 72, which forms a seal 76 with the second chamber 14 when the second chamber 14 is nested within the first chamber 12. In some cases, the first chamber neck portion 70 includes the sealing portion 72, which can be formed on an interior surface of the first chamber neck portion 70. Also, in some cases, the sealing portion 72 spans an entire interior perimeter IP1 of the first chamber neck portion 70. In certain cases, the sealing portion 72 includes a groove. Additionally, the first chamber neck portion 70 includes an anti-rotation groove 71 that can include a plurality of ribs 78. In some cases, the plurality of ribs 78 can be evenly spaced. Ribs 78 prevent chamber 14 from rotating inside chamber 12.

In the illustrated embodiment, the first chamber 12 has a cylindrical shape, though other shapes can be used instead. The first chamber 12 is also generally non-deformable, such that the size and shape of the first chamber 12 remains substantially fixed during use of the device 10. In some cases, the first chamber 12 can be made of a material having a sufficient thickness and rigidity so as to be generally non-deformable but capable of being squeezed. In some cases, the first chamber 12 comprises a polymer. In certain cases, the polymer can be a low density polyethylene. In other cases, the polymer can be a polyethylene or polypropylene, though other suitable materials can be used instead.

In certain examples, the first chamber 12 may be sized so as to hold a small dosage of a material. Accordingly, in certain non-limiting examples, the first chamber 12 has a diameter of between about 0.25 inches and about 1 inch, for instance, about 0.75 inches. Further, the first chamber 12 can have a height of between about 1 inch and about 3 inches, for example, about 1.5 inches. In some such embodiments, the first chamber 12 may hold a volume of a material between about 1 microliter and about 5 milliliters. In addition, the size of the first chamber 12 can be adjusted so as to maintain a specific component ratio between the first material 28, and a second material 32 stored in the second chamber 14.

Figure 5B:
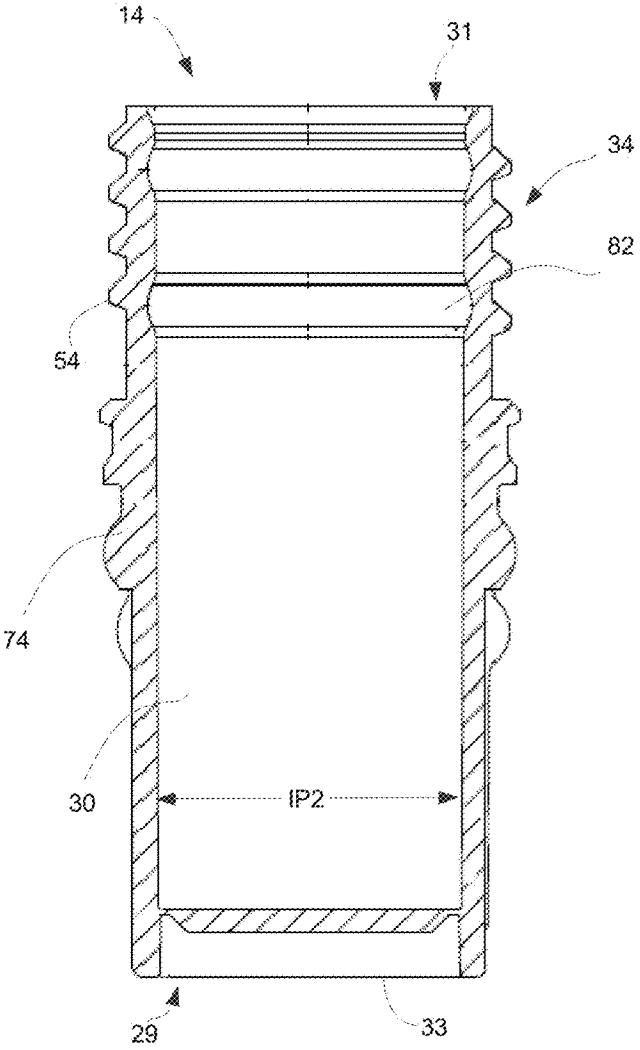
FIG. 5B is a sectional view of the second chamber shown in FIG. 5A.
Figure 5A:
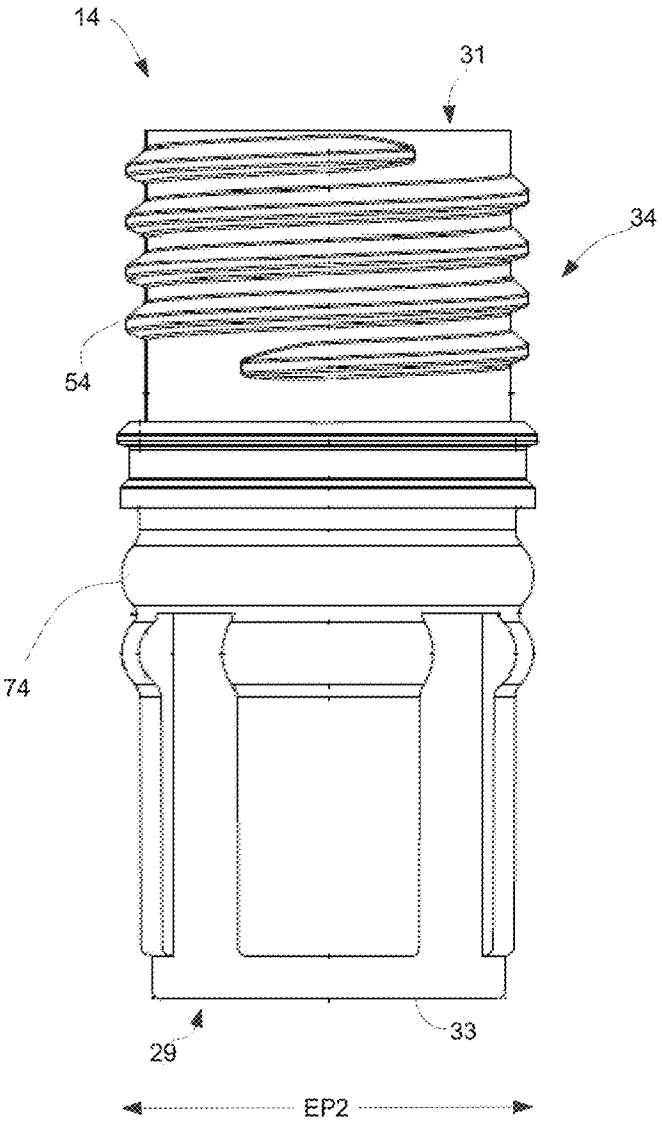
FIG. 5A is a front view of a second chamber of the dual chamber storage device according to an exemplary embodiment.

The device 10 has a second chamber 14 as shown in FIGS. 5A and 5B. The second chamber 14 also includes a hollow body 30 that stores the second material 32. In some cases, the entire second chamber 14 is configured to be a hollow body. The second chamber 14 also has a first end 29 and a second end 31. The first end 29 is opposite the second end 31. In some cases, the second chamber 14 includes a second chamber neck portion 34 proximal to the second end 31. The second chamber 14 also includes an anti-rotation bead 73, a sealing portion 74 and a sealing portion 82.

The second chamber 14 attaches to the first chamber 12. In some cases, the second chamber 14 fixedly attaches to the first chamber 12 such that the second chamber 14 does not move relative to the first chamber 12. In one embodiment, the second chamber 14 attaches to the first chamber 12 using a snap-fit connection mechanism. A variety of snap-fit connection mechanisms are known in the art and can be used. Also, in some embodiments, the second chamber 14 nests within the first chamber 12.

The second chamber 14 includes a sealing portion 74 which engages with the sealing portion 72 of the first chamber 12 to form a seal 76 (e.g., as seen in FIG. 3). In some cases, as best shown in FIG. 5A, the sealing portion 74 is formed on an exterior surface of the second chamber 14. Also, in some cases, the sealing portion 74 spans an entire exterior perimeter EP2 of the second chamber 14. In certain cases, the sealing portion 74 includes a bead that engages with a groove of the sealing portion 72 of the first chamber 12 to form the seal 76.

The second chamber 14 also includes an anti-rotation bead 73, which fits within the anti-rotation groove 71 of the first chamber 12. The one or more ribs 78 in the anti-rotation groove 71 allow for a snap-fit of the anti-rotation bead 73 within the anti-rotation groove 71. This prevents chamber 14 from rotating inside chamber 12. In some cases, a portion of anti-rotation bead 73 can be removed to improve engagement of the anti-rotation bead 73 with the anti-rotation groove 71.

The second chamber 14 includes an additional sealing portion 82 which forms a seal 86 with the dispenser 16 when the second chamber 14 is in the deformed state. The second chamber 14 also includes an additional sealing portion 83, which forms the seal 86 with dispenser 16 when the second chamber 14 is not in the deformed state. In some cases, the second chamber neck portion 34 includes the sealing portion 82, which can be formed on an interior surface of the second chamber neck portion 34. Also, in some cases, the sealing portion 82 spans an entire interior perimeter of the second chamber neck portion 34. In certain cases, the sealing portion 82 includes a groove.

The second chamber neck portion 34 also includes a second chamber threaded portion 54. In this example, the second chamber threaded portion 54 is formed on an exterior surface of the neck portion 34, as best shown in FIG. 5A. In some cases, the threaded portion 54 spans an entire exterior perimeter EP2 of the second chamber 14. The second chamber 14 also has a cylindrical shape, though other shapes are contemplated. The second chamber 14 also comprises a polymer. In certain cases, the polymer can be a low density polyethylene. In other cases, the polymer can be a polyethylene or polypropylene, though other suitable materials can be used instead.

The second chamber 14 also includes a deformable portion. In some cases, the deformable portion is a deformable base. For example, the deformable base comprises a material than can be deformed by cutting or piercing. In the illustrated embodiment, the deformable base is a base 27 positioned proximal to the first end 29, as best shown in FIG. 5B. In some cases, the deformable base 27 is positioned above a bottom edge 33 of the second chamber 14. Also, in some cases, the deformable base 27 is positioned inside of the second chamber 14.

In some embodiments, the deformable base comprises a deformable material whereas the remaining components of the second chamber 14 comprise a non-deformable material. For example, the deformable base can comprise a foil seal whereas the remaining components comprises a polymer. In certain cases, the polymer can be a low density polyethylene. In other cases, the polymer can be a polyethylene or polypropylene, though other suitable materials can be used instead.

In other cases, both the deformable base and the remaining components are of the same material but have differing thicknesses. For example, the deformable base and the remaining components can both comprise a polymer, such as a low density polyethylene. However, the deformable base has a thickness small enough that enables the base to easily be deformed by cutting or piercing, whereas the remaining components have a thickness large enough that renders the components non-deformable. In some cases, the deformable base can have a thickness between about 0.010 inches and 0.03 inches. In some cases, the remaining components can have a thickness between about 0.015 inches and 0.04 inches.

Referring back to FIGS. 2 and 3, in some cases, the second chamber 14 comprises a vent 80 disposed outside of the hollow body of the second chamber 14. The vent 80, in the illustrated example, is positioned below the first seal 76, such that the vent 80 may permit venting of the first chamber 12 while simultaneously fluidly isolating the first material 28 from the second material 32. In one case, the vent 80 permits venting of the first chamber 12 during lyophilization.

The device 10 also includes a dispenser 16 as shown in FIGS. 7A, 7B and 7C. The dispenser 16 includes a hollow body 36 and a first end 40 and a second end 38. The first end 40 is opposite the second end 38. The first end 40 includes a deforming structure 46 that is capable of deforming the deformable base of the second chamber 14. The second end 38 includes a dispensing tip 42 for controlling delivery of a mixture of the first material 28 and the second material 32. The dispenser 16 also includes a sealing portion 84 and a sealing portion 104. The dispenser 16 can comprise a polymer. In certain cases, the polymer can be a polystyrene. In other cases, the polymer can be a polyethylene or polypropylene, though other suitable materials can be used instead.

In some embodiments, the deforming structure 46 is a deforming edge 48 capable of deforming the base. In certain cases, the deforming edge 48 cuts or pierces the base. The deforming edge 48 can be at an angle of 3° to 15° and can either be smooth yet sharp, or optionally include serrations 6. In FIG. 3, the deforming edge 48 is illustrated without serrations 6, whereas in FIG. 2, the deforming edge 48 is illustrated with serrations 6. The deforming edge 48, as seen from FIGS. 2 and 3, comprises a cutting edge perimeter (best seen in FIG. 7A). In certain advantageous aspects, the serrations 6 are provided throughout the perimeter of the deforming edge 48.

The dispenser 16 attaches to the second chamber 14. In one embodiment, the dispenser 16 attaches to the second chamber 14 using a snap-fit connection mechanism. A variety of snap-fit connection mechanisms are known in the art and can be used.

The dispenser 16 has a sealing portion 84 that engages with the sealing portion 82 of the second chamber 14 to form a seal 86 when the second chamber 14 is in the deformed state. The sealing portion 84 engages with the sealing portion 83 of the second chamber 14 to form the seal 86 when the second chamber 14 is not in the deformed state (e.g., as seen in FIG. 3). In some cases, as best shown in FIG. 7B, the sealing portion 84 is formed on an exterior surface of the dispenser 16. Also, in some cases, the sealing portion 84 spans an entire exterior perimeter EP3 of the dispenser 16. In certain cases, the sealing portion 84 includes a bead that engages with the groove of the sealing portion 82 of the second chamber 14 to form the seal 86. Also, the one or more ribs can be provided in the groove allow for a snap-fit of the bead within the groove. Referencing FIG. 3, the seal 86 is axially offset from the seal 76.

The dispenser 16 also includes a dispensing tip 42, which can be sized and shaped to deliver a precise amount of the mixture. In some cases, the dispensing tip 42 is sized and shaped to deliver a mixture in an amount of between about 1 microliters and 100 microliters, for instance about 20 microliters. FIG. 7C shows an enlarged sectional view of the dispensing tip 42. The dispensing tip 42 has a generally tapered body portion 92 terminating in an aperture 94. The aperture 94 is in fluid communication with the hollow body 36 of the dispenser 16 and permits a mixture to flow through.

In some embodiments, the dispensing tip 42 has a top surface 96 and the aperture 94 is recessed from the top surface 96. Such embodiment can be beneficial in reducing leakage during use while also providing a precise dose corresponding to the size and shape of the dispensing tip 42. In certain examples, the aperture 94 is generally cylindrical in shape and has a diameter of between about 0.01 inches and about 0.5 inches. In some such examples, the aperture 94 has a diameter of about 0.025 inches.

Also, in some embodiments, the generally tapered body portion 92 can have a taper angle 98, defined relative to a central axis of the dispenser 16 of between about 5 degrees and about 30 degrees. In certain examples, the taper angle 98 can be about 10 degrees.

The dispenser 16 also includes a sealing portion 104 provided along the generally tapered body portion 92 of the dispensing tip 42. The sealing portion 104 engages with a sealing portion 106 of the cap 20 to form a seal 108 (e.g., as seen in FIG. 3). In some cases, as best shown in FIG. 7C, the sealing portion 104 is formed on an exterior surface of the dispensing tip 42. Also, in some cases, the sealing portion 104 spans an entire exterior perimeter EP4 of the dispensing tip 42. In certain cases, the sealing portion 104 includes a bead that contacts the top of a bead in the sealing portion 106 of the cap 20 to form the seal 108.

The dispenser 16 is movable relative to the second chamber 14. For example, in embodiments, the dispenser 12 is movable towards the second chamber 14.

The device 10 also includes a cap 20 that substantially surrounds an upper portion of the device 10 so as to isolate the device 10 from moisture, dust and other extraneous particles, thereby ensuring product stability. The cap 20 can also be made of a material such as high density polyethylene or polypropylene, though other materials are contemplated within the scope of the present disclosure.

Figure 4B:
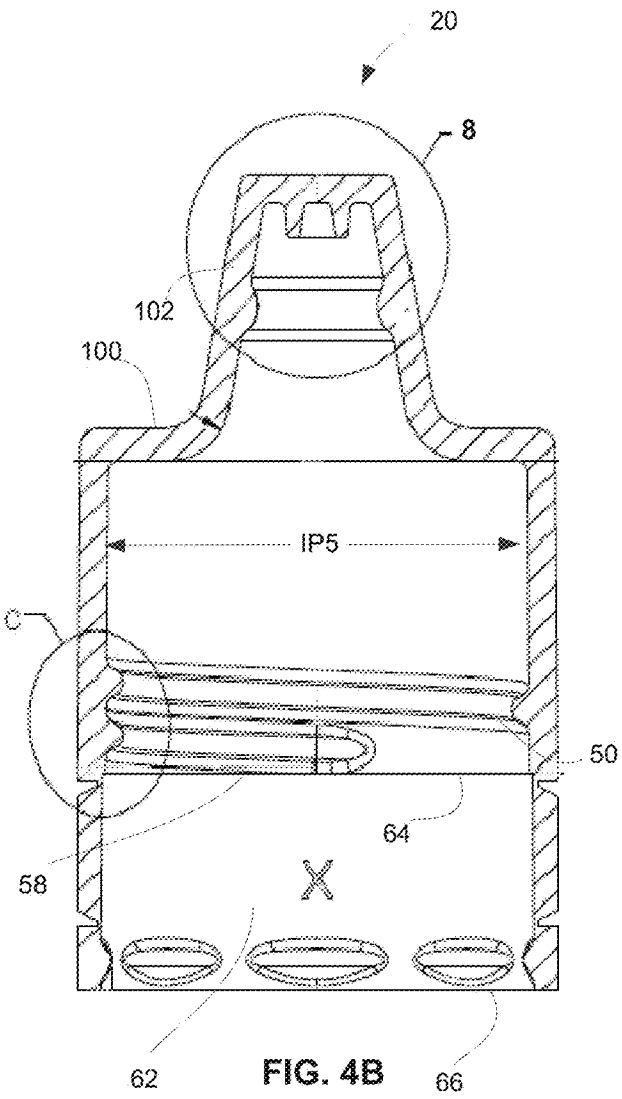
FIG. 4B is a sectional view of the cap shown in FIG. 4A.
Figure 4A:
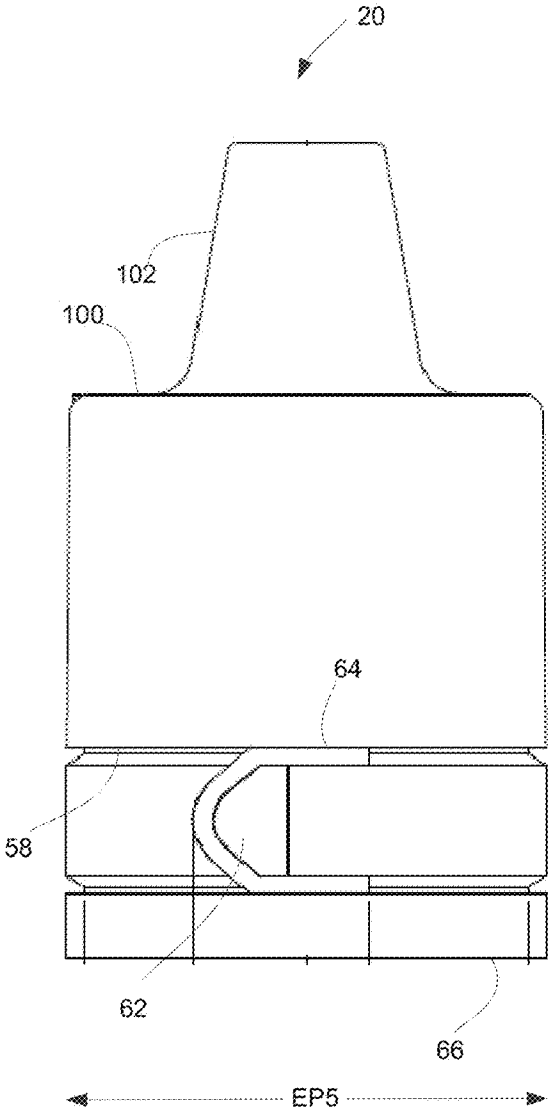
FIG. 4A is a front view of a cap of the dual chamber storage device according to an exemplary embodiment.

FIGS. 4A and 4B illustrate an exemplary embodiment of the cap 20. The cap 20 comprises a threaded portion 50. In this example, the threaded portion 50 is formed on an interior surface of the cap 20. In some cases, the threaded portion 50 spans an entire interior surface of the cap 20. In certain cases, the threaded portion 50 spans an entire interior perimeter IP5 of the cap 20. The cap 20 also includes a bottom edge 66, which is the lowermost boundary of the cap 20. Additionally, the cap includes a generally planar top surface 100 positionable to be in contact with the generally planar top surface 90 of the dispenser 16. Referring now to FIG. 8, the cap 20 includes a tapered portion 102 positioned above the generally planar top surface 100 of the cap 20. The tapered portion 102 of the cap 20 is sized and shaped to generally match the size and shape of the tapered body portion 92 of the dispensing tip 42.

The cap 20 attaches to the dispenser 16. In some cases, the cap 20 is fixedly and/or rigidly and/or non-rotatingly attachable to the dispenser 16. Also, in some cases, the cap 20 attaches to a second end 38 of the dispenser 16. In certain cases, the cap 20 fixedly and/or rigidly and/or non-rotatingly attaches to the second end 38.

The cap 20 also attaches to the second chamber 14. In some cases, the cap 20 is rotatingly attachable to the second chamber 14. Also, in some cases, the cap 20 is attachable to a second end 34 of the second chamber 14. In certain cases, the cap 20 is rotatably attachable to the second end 34. In certain embodiments, the threaded portion 50 of the cap 20 threads or screws around the threaded portion 54 of the second chamber 14. In the illustrated embodiment, the threaded portion 54 is a male portion that threads or screws into the threaded portion 50, which is a female portion. Of course, in other embodiments, the threaded portion 50 can be a male portion that threads into a female threaded portion 54.

The cap 20 has a sealing portion 106 that engages with a sealing portion 104 of the dispenser 16 to form a seal 108. As shown in FIG. 8, the sealing portion 106 is formed on an interior surface of the cap 20.

In certain embodiments, the cap 20 is rotatingly attachable with the second end 34 of the second chamber 14 while being fixedly attachable to the second end 38 of the dispenser such that when the cap 20 is rotated relative to the second chamber neck portion 34, the cap 20 does not rotate with respect to the first end 38 of the dispenser 16. During rotation of the cap 20, a force/torque is exerted on the second end 38 of the dispenser 16, thereby causing the first end 40 and thus the deforming structure 46 to move toward the base of the second chamber 14. As the deforming structure 46 contacts the base 27, it deforms the base 27, thereby allowing the second material 32 to enter the first chamber 12.

As seen from FIG. 1, the device 10 can also include a tamper evident ring 62 positioned between the cap 20 and the first chamber 12. The tamper evident ring 62 can be a "warranty seal" to a user. For example, if the tamper evident ring 62 is present, a user can assume that the device 10 has not been used and thus the first material 28 in the first chamber 12 and the second material 32 in the second chamber 14 have not been mixed. However, if the tamper evident ring 62 is not present, a user can assume the device 10 has been tampered or used and thus the first material 28 and the second material 32 may have been mixed.

With reference to FIG. 4A, the tamper evident ring 62 can include a top edge 64 and a bottom edge 66. The top edge 64 of the tamper evident ring 62 is positioned so as to abut the bottom edge 58 of the cap 20, and the bottom edge 66 of the tamper evident ring 62 is positioned so as to abut the top edge 60 of the first chamber 12. When the tamper evident ring 62 is in place, the cap 20 is not rotatable relative to the second chamber neck portion 34. When the tamper evident ring 62 is removed, the cap 20 is rotatable relative to the second chamber neck portion 34. Thus, during use, the user removes the tamper evident ring 62 prior to rotatingly engaging the first threaded portion 50 and the second threaded portion 54.

FIGS. 9-14B illustrate the device according to another embodiment. The device, according to this embodiment may include a cap kit 200 connectable with a first container 202, and a second container 204. The first container 202 can be substantially similar to the first chamber 12. Alternatively, the first container 202 can be substantially different from the first chamber 12. The first container 202 can be an off-the-shelf component, such as a vial. The first container 202 can be made from many different types of materials, such as glass, polymer, etc. The first container 202 can store the first material 28.

The cap kit 200 can include a first cap 210. The first cap 210 can engage with the first container 202. In one example, the first cap 210 can include threads (best seen in FIG. 12). In the illustrated embodiment, the threads of the first cap 210 are defined on an interior surface of the first cap 210. The first container 202 can have corresponding threads on an exterior surface of the first container 202. Accordingly, the threads of the first cap 210 can engage with the threads of the first container 202. Alternative types of connections (such as threads other than those illustrated, frictional engagement, snap-fit, and the like) are contemplated within the scope of this disclosure.

The first cap 210 can be made of a polymer such as polypropylene, although other materials are contemplated within the scope of the present disclosure. The first cap 210 can be made by a process such as injection molding, though, other processes (including additive manufacturing) are contemplated within the scope of the present disclosure. The surfaces of the first cap 210 can have a desired finish, for instance, an SPI Finish designation such as a D-1 (e.g., dry blast of a suitable size) finish. The finish of the surfaces of the first cap 210 can be different in certain portions of the second cap 212. For instance, interior surfaces of the first cap engagement portion 216 and/or the first cap ring portion 230 can have a different surface finish (e.g., an SPI finish designation such as A-3 or better).

As seen in FIGS. 9-12 and 14A-B, the cap kit 200 can also include a second cap 212. The second cap 212 can be engaged with a second container 204. The second container 204 can be substantially similar to the second chamber 14. Alternatively, the second container 204 can be substantially different from the second chamber 14. The second container 204 can be an off-the-shelf component such as a vial or a micro-tube. The second container 204 can be made from many different types of materials, such as glass, polymer, etc. The second container 204 can store the second material 32.

The second cap 212 can engage with the second container 204. In one example, the second cap 212 can include threads to engage with the second container 204. In the illustrated embodiment, the threads of the second cap 212 are defined on an interior surface of the second cap 212. The second container 204 can have corresponding threads on an exterior surface of the second container 204. Accordingly, the threads of the second cap 212 can engage with the threads of the second container 204. Alternative types of connections (such as threads other than those illustrated, frictional engagement, snap-fit, and the like) are contemplated within the scope of this disclosure.

The second cap 212 can be made of a polymer such as low density polyethylene, although other materials are contemplated within the scope of the present disclosure. The second cap 212 be made by a process such as molding, though, other processes (including additive manufacturing) are contemplated within the scope of the present disclosure. The surfaces of the second cap 212 can have a desired finish, for instance, an SPI Finish designation such as a D-1 finish. The finish of the surfaces of the second cap 212 can be different in certain portions of the second cap 212. For instance, exterior surfaces of the second cap engagement portion 266 can have a different surface finish (e.g., an SPI finish designation such as A-3 or better). In certain embodiments, the entirety of the first cap 210 and the second cap 212 can have substantially the same finish to facilitate ease of manufacturing and reduce cost of fabricating the cap kit. Alternatively, the first cap 210 and the second cap 212 or portions thereof can have different surface finishes.

In certain embodiments, the first cap 210 and the second cap 212 can form the cap kit 200 for use with off-the-shelf containers such as vials, micro-tubes, and the like. A user can connect the first container 202 having the first material 28 (e.g., lyophilized powder sealed in the first container 202) to the first cap 210 and connect the second container 204 (e.g., micro-tube having the second material 32) to the second container 204. The first and second materials 28 and 32 can be protected by the cap kit prior to use. Such embodiments can provide an easy to use cap kit for engaging with different types of containers.

Figure 11:
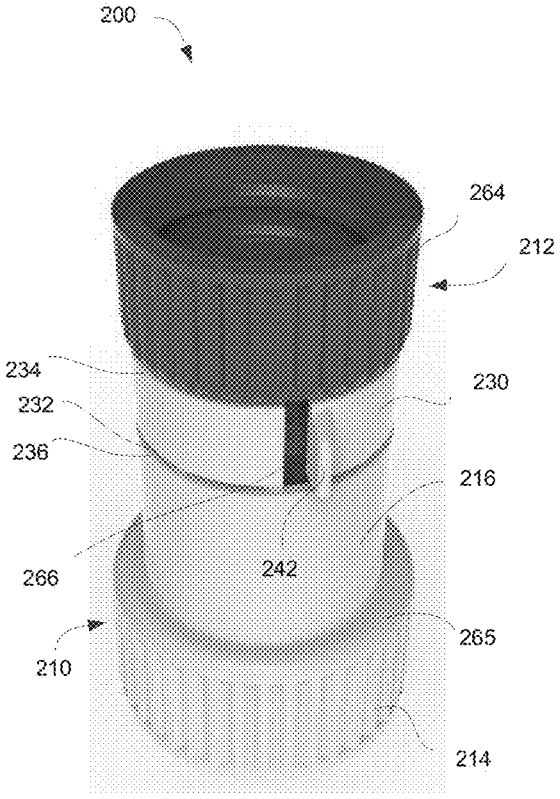
FIG. 11 is a perspective view of a cap kit usable with the storage device of FIG. 9 according to an embodiment.
Figure 12:
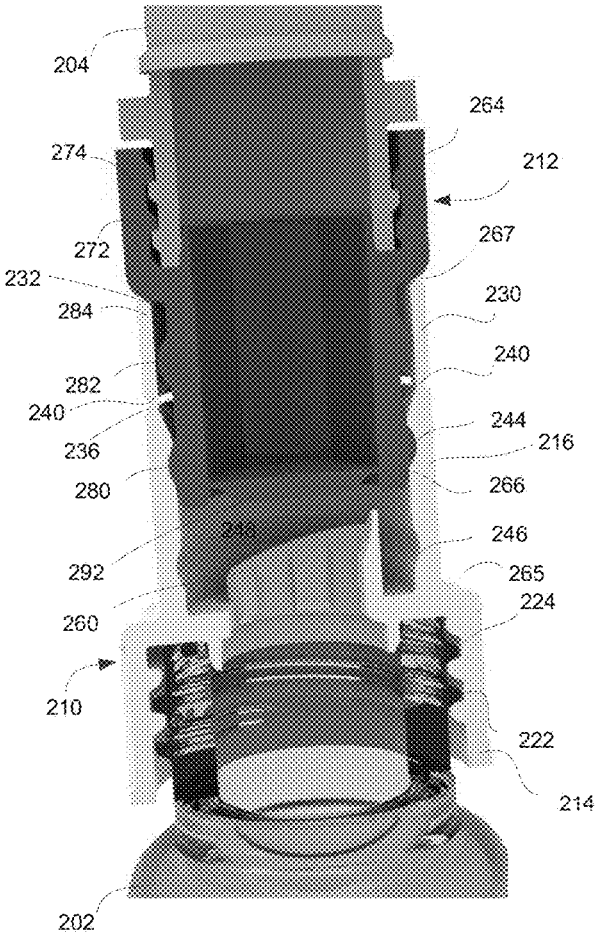
FIG. 12 is a sectional front view of the cap kit of FIG. 11.

As best seen in FIGS. 11 and 12, according to some embodiments, the first cap 210 can receive and surround the first container 202 to enclose and protect the contents (e.g., the first material 28) of the first container 202. In additional embodiments, the second cap 212 substantially surrounds the second container 204 to enclose and protect the contents (e.g., the second material 32) of the second container 204. Further, advantageously, the first cap 210 can receive and surround the second cap 212.

FIGS. 11, 12, and 13A-C illustrate various views of the first cap 210 according to an embodiment. The first cap 210 has a first cap base portion 214 and a first cap engagement portion 216. In one example, the first cap base portion 214 and the first cap engagement portion 216 each have a circular cross-section. However, other cross-sectional shapes can be contemplated.

The first cap base portion 214 has a first cap base portion diameter 218 and a first cap base portion height 220. The first cap base portion diameter 218 can be suitably chosen to engage with any commercially available first container 202. The first cap base portion 214 can include threads 222 to engage with the first container 202 (e.g., vials of different sizes). The threads can be of a suitable pitch and type to engage with any commercially available first container 202 (e.g., vials of different sizes). The threads may be located on an interior surface 224 of the first cap base portion 214, and may start at a first distance 226 from an edge 228 of the first cap base portion 214.

Figure 13C:
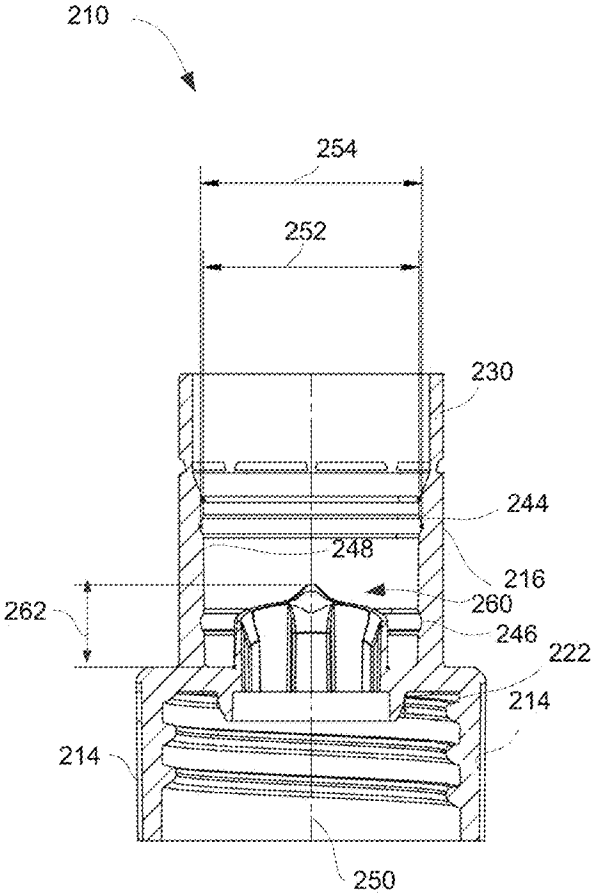
FIG. 13A is a front view of a first cap of the cap kit shown in FIG. 11 according to an embodiment.
FIGS. 13B and 13 C are each sectional front views of the first cap shown in FIG. 13A.
Figure 13B:
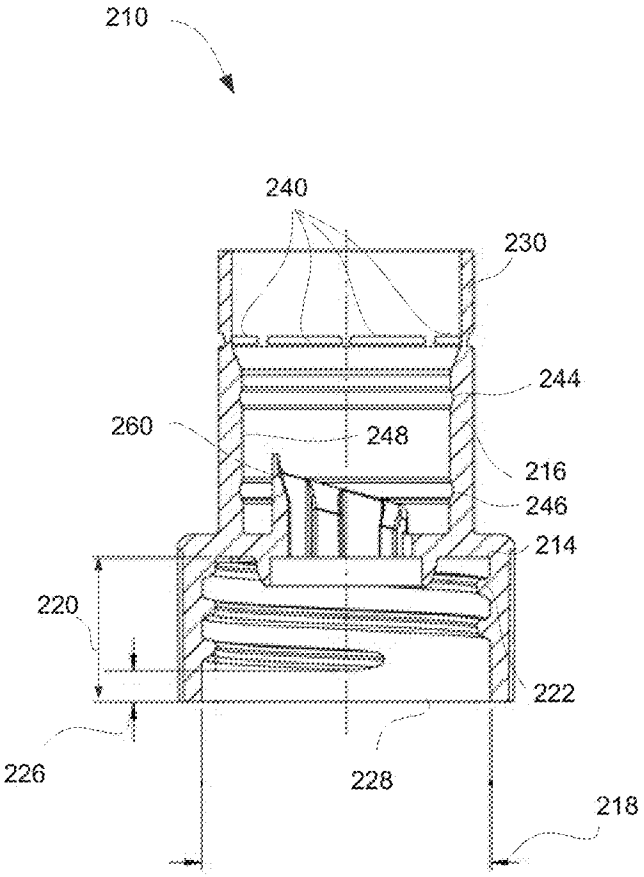
Figure 13A:
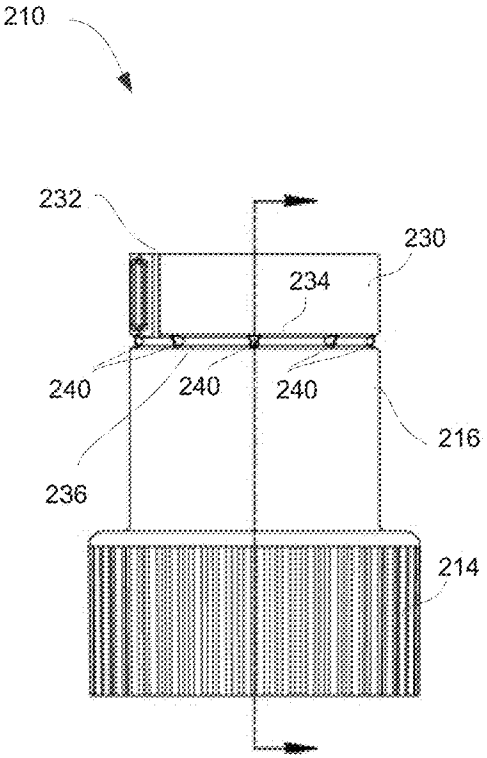

In some embodiments, the first cap 210 can also include a first cap ring portion 230. The first cap ring portion 230 can be detachably coupled to the first cap engagement portion 216. The first cap ring portion 230 can have an outer edge 232 and an inner edge 234. The outer edge 232 can be an outermost edge of the first cap ring portion 230 and the inner edge 234 can be an innermost edge of the first cap ring portion 230. The inner edge 234 of the first cap ring portion 230 can be closer to an outer edge 236 of the first cap engagement portion 216 than the outer edge 232 of the first cap ring portion 230. The outer edge 236 of the first cap engagement portion 216 can be an outermost edge. For example, as seen in FIGS. 13A-C, the first cap 210 can include a plurality of tabs 240 defined on the inner edge of the first cap ring portion 230 and/or outer edge of the first cap engagement portion 216 to engage the first cap ring portion 230 to the first cap engagement portion 216. As shown in FIG. 11, the first cap ring portion 230 can include a tearing tab 242. During use, to detach the first cap ring portion 230, the tearing tab 242 can be grasped and pulled circumferentially, thereby tearing the first cap ring portion 230 from the first cap engagement portion 216.

With reference to FIGS. 12, 13B, and 13C, the first cap engagement portion 216 includes a first groove 244 and a second groove 246 in some embodiments. The first groove 244 and the second groove 246 can be defined on an interior surface 248 of the first cap engagement portion 216. The first groove 244 can be axially spaced apart from the second groove 246, along a first cap center axis 250. For example, the first groove 244 can be an outermost groove and positioned further away from the first cap base portion 214 than the second groove 246. The second groove 246 can be an innermost groove and can be positioned closer to the first cap base portion 214 than the first groove 244. The first groove 244 and the second groove 246 can each have a groove diameter 254. The groove diameter 254 can be larger than a nominal diameter 252 of the interior surface 248 of the first cap engagement portion 216.

As seen in FIGS. 12, 13B and 13C, the first cap 210 includes a piercing protrusion 260. The piercing protrusion 260 can extend from the first cap base portion 214. The piercing protrusion 260 can be housed within the first cap engagement portion 216. For example, the piercing protrusion 260 can project past the second groove 246. The piercing protrusion 260 can have a piercing protrusion height 262. In certain illustrated embodiments, the piercing protrusion 260 can be coaxial with the first cap base portion 214 and/or the first cap engagement portion 216. The piercing protrusion 260 can be centered on the first cap center axis 250. Alternatively, the piercing protrusion 260 can be off-axis with the first cap center axis 250 in other embodiments.

FIGS. 9-12, 14A, and 14B illustrate various views of the second cap 212 according to an embodiment. The second cap 212 has a second cap base portion 264 and a second cap engagement portion 266. In one example, the second cap base portion 264 and the second cap engagement portion 266 each have a circular cross-section. However, other cross-sectional shapes can be contemplated.

The second cap base portion 264 has a second cap base portion diameter 268 and a second cap base portion height 270. The second cap base portion diameter 268 can be suitably chosen to engage with any commercially available second container 204. The second cap base portion 264 can include threads 272 to engage with the second container 204 (e.g., vials, micro-tubes of different sizes). The threads can be of a suitable pitch and type to engage with any commercially available second container 204 (e.g., vials, micro-tubes of different sizes). The threads may be located on an interior surface 274 of the second cap base portion 264, and may start at a second distance 276 from an edge 278 of the second cap base portion 264.

Figure 14A:
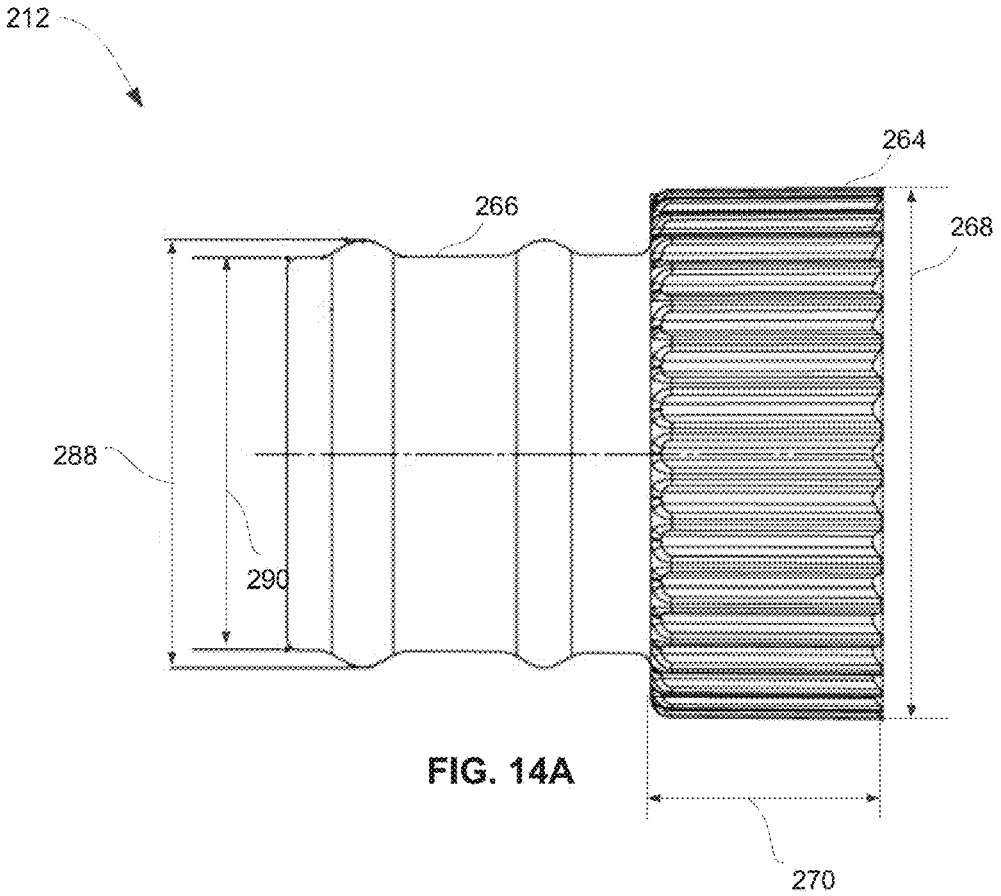
FIG. 14A is a front view of a second cap of the cap kit shown in FIG. 11 according to an embodiment.
Figure 14B:
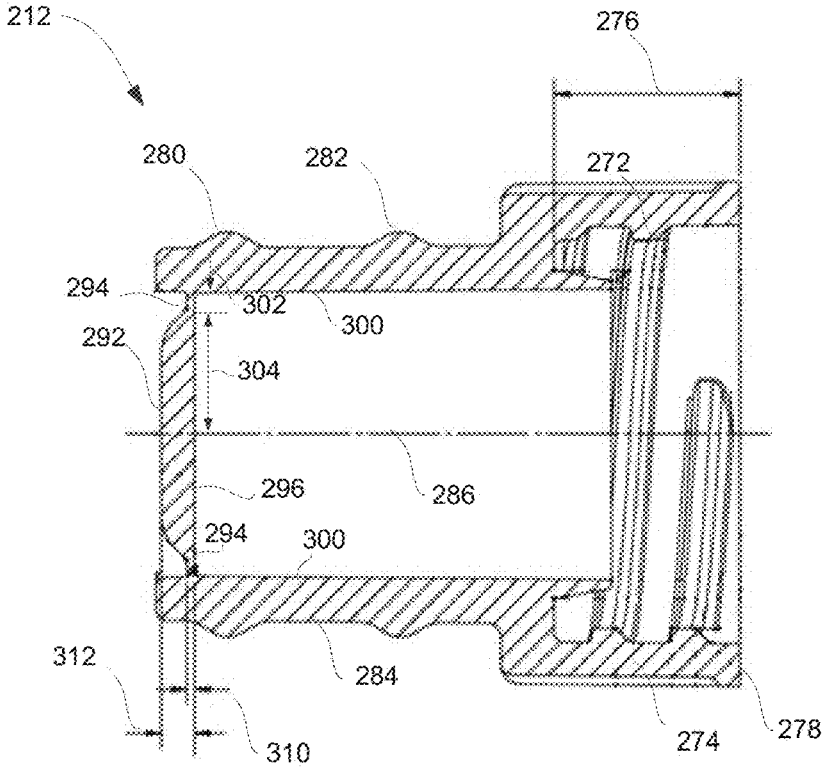
FIG. 14B is a sectional front view of the second cap shown in FIG. 14A.

With reference to FIGS. 12 and 14B, the second cap engagement portion 266 includes a first rib 280 and a second rib 282 in some embodiments. The first rib 280 and the second rib 282 can be defined on an exterior surface 284 of the second cap engagement portion 266. The first rib 280 can be axially spaced apart from the second rib 282, along a second cap center axis 286. For example, the first rib 280 can be an outermost rib and positioned further away from the second cap base portion 264 than the second rib 282. The second rib 282 can be an innermost rib and can be positioned closer to the second cap base portion 264 than the first rib 280. The first rib 280 and the second rib 282 can each have a rib diameter 288. The rib diameter 288 can be larger than a nominal diameter 290 of the exterior surface 284 of the second cap engagement portion 266.

As seen in FIGS. 12 and 14B, the second cap 212 includes a protective surface 292. The protective surface 292 can, in some embodiments, form an outermost surface of the second cap 212 in the axial direction. In some such cases, the protective surface 292 can be in the form of a membrane. The protective surface 292 can be substantially flexible relative to the second cap base portion 264 and/or second cap engagement portion 266. In one example, the protective surface 292 can be made of the same material as the second cap 212. In such cases, the protective surface 292 can have a thickness substantially less than the thickness of a portion of the second cap 212. For example, the protective surface 292 can have a thickness substantially less than the thickness of the lateral portion 300 of the second cap 212. Accordingly, the protective surface 292 can be deformable (e.g., pierced/torn, etc.) Alternatively, in another example, the protective surface 292 can be made of a different material (e.g., more deformable/flexible material) from the material of the second cap 212.

In one example, the thickness of the protective surface 292 may not be uniform. For example, the protective surface 292 can have an outer portion 294 and an inner portion 296. The outer portion 294 of the protective surface 292 can attach to the lateral portion 300 of the second cap 212. The outer portion 294 can be radially further outward than the inner portion 296. The outer portion 294 can extend radially over an outer radial distance 302, while the inner portion 296 can extend radially over an inner radial distance 304. In the embodiment illustrated in FIG. 14B, the inner radial distance 304 is greater than the outer radial distance 302. The outer radial distance 302 can be such that the outer portion 294 at least partially radially overlaps with of the piercing protrusion 260 (best seen in FIGS. 13B and 13C). However, the outer radial distance 302 can be greater than the inner radial distance 304 in alternative embodiments.

The outer portion 294 can have an outer portion thickness 310 and the inner portion 296 can have an inner portion thickness 312. The outer portion thickness 310 can be less than the inner portion thickness 312, to facilitate ease of deformation of the protective surface 292. In alternative embodiments, the outer portion thickness 310 and the inner portion thickness 312 can be substantially the same.

Figure 9:
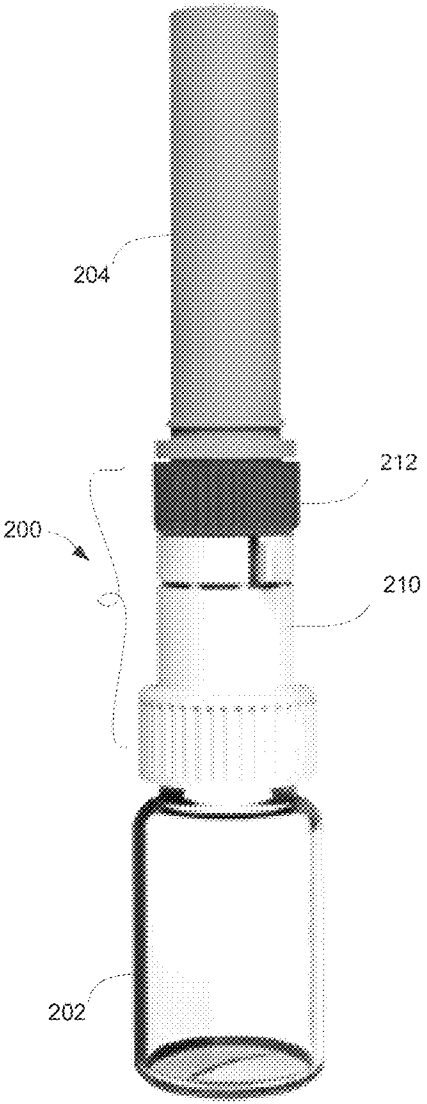
FIG. 9 is a front view of a storage device according to another embodiment illustrated in an assembled configuration.

With reference to FIGS. 9 and 12, prior to the protective surface 292 being deformed, the first cap 210 and the second cap 212 can be engaged with each other in a first position. In the first position, the first cap base portion 214 is oriented generally opposite to the second cap base portion 264. For instance, the first cap base portion 214 can have an outer edge 265 and the second cap base portion 264 can have an outer edge 267. The outer edges 265, 267 of the first cap base portion 214 and the second cap base portion 264 can each be the outermost edges of the first cap base portion 214 and the second cap base portion 264 respectively. The outer edges 265, 267 of the first cap base portion 214 and the second cap base portion 264 can be opposite to each other along the central axis.

In the first position, first rib 280 is received within the first groove 244. The outer edge of the first cap ring portion 230 abuts the outer edge of the second cap base portion 264. The inner edge of the first cap ring portion 230 abuts the outer edge of the first cap engagement portion 216. In the first position, the protective surface 292 can be opposite to the piercing protrusion 260. The protective surface 292 can be spaced apart from the piercing protrusion 260 such that the protective surface 292 is not deformed. However, because the protective surface 292 has not been deformed, the second material 32 can be protected and enclosed within the second container 204.

At certain positions, the second cap 212 can be movable (slidable along the central axis and/or rotationally about the central axis) with respect to the first cap 210 to deform (e.g., pierce or tear) the protective surface 292. In one example, the second cap 212 can be movable with respect to the first cap 210, when the first cap ring portion 230 is detached from the first cap engagement portion 216. Once the first cap ring portion 230 is removed, the second cap 212 can be moved with respect to the first cap 210, such that the outer edge of the second cap base portion 264 can abut the outer edge of the first cap engagement portion 216.

At this position, the first rib 280 can engage with the second groove 246, and the second rib 282 can engage with the first groove 244. The piercing protrusion 260 can abut and deform the outer portion 294 of the protective surface 292. Once deformed, the second material 32 can be received within the first material 28 (e.g., by gravity or by shaking the first and/or second containers). Alternatively, the device can be inverted to receive the first material 28 in the second container 204 in other embodiments.

In some embodiments, prior to use, the protective surface 292 may not be deformed, and the outer edge 232 of the first cap ring portion 230 can abut the outer edge 267 of the second cap base portion 264. A user may grasp and pull the tearing tab 242 of the first cap ring portion 230. The first cap ring portion 230 may be detached from the first cap engagement portion 216. The second cap 212 can be pushed such that the outer edge 267 of the second cap base portion 264 abuts the outer edge 236 of the first cap engagement portion 216. The first rib 280 can engage with the second groove 246, the second rib 282 can engage with the first groove 244, and the piercing protrusion 260 can pierce the protective surface 292. The first and second material 32 can be mixed. The user may, optionally, remove the first cap 210 and/or the second cap 212 by detaching the threaded connection (e.g., by providing a torque) between the first cap 210 and the first container 202 and/or the second cap 212 and the second container 204.

The disclosed embodiments have one or more advantages. The device according to certain examples of the present disclosure can permit one step rehydration of lyophilized materials. Further, the device can permit controlled mixing and precise delivery of a material (particularly liquids of a desired droplet size). Certain embodiments of the device permit maintaining specific material and/or component ratios. Further, as a result of effective sealing of the device, product stability can be maintained during processing (e.g., lyophilization) and/or prior to use.

Various examples have been described.

The invention claimed is:

1. A dual chamber storage device comprising:
- a first chamber comprising:
- a base; and
- a hollow body configured to store a first material;
- a second chamber housed within the hollow body of the first chamber, the second chamber comprising:
- a base;
- a hollow body configured to store a second material; and
- a vent configured to permit venting of the first material in the first chamber while simultaneously isolating the first material from the second material;
- a dispenser housed within the second chamber, the dispenser comprising:
- a hollow body;
- a dispensing tip provided on a first end of the hollow body; and
  - a cutting edge provided on a second end of the hollow body, the second end being opposite to the first end; and
- a cap configured to surround the second end of the dispenser so as to seal the dual chamber storage device.

2. The dual chamber storage device of claim 1, wherein:
- the cap is rotatingly connectable with the second chamber neck portion and non-rotatingly connectable with the first end of the dispenser; and
- when the cap is rotated relative to the second chamber, the second end of the dispenser moves toward the base of the second chamber and the cutting edge pierces the base of the second chamber thereby allowing the second material to enter the hollow body of the first chamber.

3. The dual chamber storage device of claim 1, wherein the first chamber further comprises a first sealing portion; and
- wherein the hollow body of the second chamber comprises a second sealing portion engageable with the first sealing portion so as to form a fluid-tight seal.

4. The dual chamber storage device of claim 3, wherein the second chamber comprises a third sealing portion, and the hollow body of the dispenser comprises a fourth sealing portion engageable with the third sealing portion to form a second fluid-tight seal.

5. The dual chamber storage device of claim 1, wherein the vent is positioned outside of the hollow body of the second chamber.

6. The dual chamber storage device of claim 1, wherein the second chamber is sealingly connected to the hollow body of the first chamber through a seal and the vent is positioned below the seal.

7. The dual chamber storage device of claim 1, wherein the first material is a lyophilized material or a material configured to be lyophilized and the second material is a liquid.

8. The dual chamber storage device of claim 1, wherein the dispenser comprises a dispensing tip that is sized and shaped to deliver a mixture of the first material and the second material in an amount of between about 1 microliters and 100 microliters.

9. The dual chamber storage device of claim 1, wherein the dispenser comprises a dispensing tip that is sized and shaped to deliver a mixture of the first material and the second material in an amount of between about 1 microliters and 20 microliters.

10. The dual chamber storage device of claim 8, wherein the dispensing tip has a top surface and an aperture, the aperture being recessed from the top surface.

11. A method of delivering a homogenized mixture of two materials, the method comprising:
- providing a dual chamber storage device comprising;
  - a first chamber comprising:
  - a base; and
  - a hollow body configured to store a first material;
  - a second chamber housed within the hollow body of the first chamber, the second chamber comprising:
  - a base;
  - a hollow body configured to store a second material; and
    - a vent;
  - a dispensing tip provided on a first end of the hollow body; and
    - a cutting edge provided on a second end of the hollow body, the second end being opposite to the first end;
  - venting the first material in the first chamber through the vent while simultaneously isolating the first material from the second material;
  - deforming the second chamber so as to deliver the second material into the first chamber;
  - mixing the first material with the second material; and
  - inverting the dual chamber storage device to deliver a homogenized mixture of the first material and the second material.

12. The method of claim 11, wherein the venting comprises venting the first material in the first chamber during lyophilization.

13. The method of claim 11, wherein deforming the second chamber comprises deforming a base of the second chamber using the cutting edge of the dispenser.

14. A dual chamber storage device comprising:

a first chamber comprising:

a base; and a hollow body configured to store a first material;

a second chamber housed within the hollow body of the first chamber, the second chamber comprising:

a base;

a hollow body configured to store a second material; and a vent that permits venting of the first material in the first chamber while simultaneously isolating the first material from the second material;

a dispenser housed within the second chamber, the dispenser comprising:

a hollow body;

a dispensing tip provided on a first end of the hollow body, the dispensing tip dispensing tip comprising a top surface and an aperture, the aperture being recessed from the top surface, the aperture being sized and shaped to deliver a mixture of the first material and the second material in an amount of between about 1 microliters and 100 microliters;

a cutting edge provided on a second end of the hollow body, the second end being opposite to the first end; and a cap configured to surround the second end of the dispenser so as to seal the dual chamber storage device.

15. The dual chamber storage device of claim 14, wherein the aperture is sized and shaped to deliver a mixture of the first material and the second material in an amount of between about 1 microliters and 20 microliters.

16. The dual chamber storage device of claim 14, wherein the cap is rotatingly connectable with the second chamber and non-rotatingly connectable with the first end of the dispenser; and when the cap is rotated relative to the second chamber, the second end of the dispenser moves toward the base of the second chamber and the cutting edge pierces the base of the second chamber thereby allowing the second material to enter the hollow body of the first chamber.

17. The dual chamber storage device of claim 14, wherein the first material is a lyophilized material or a material configured to be lyophilized and the second material is a liquid.

18. The dual chamber storage device of claim 14, wherein the vent is positioned outside of the hollow body of the second chamber.

* * * * *